United States Patent [19]

Matsui

[11] Patent Number: 4,506,380

[45] Date of Patent: Mar. 19, 1985

[54] METHOD AND APPARATUS FOR CONTROLLING THE SOUND FIELD IN A VEHICLE CABIN OR THE LIKE

[75] Inventor: Shinichi Matsui, Yokosuka, Japan

[73] Assignee: Nissan Motor Company, Limited, Yokohama, Japan

[21] Appl. No.: 508,934

[22] Filed: Jun. 29, 1983

[30] Foreign Application Priority Data

Jul. 7, 1982 [JP] Japan ..... 57-118913

[51] Int. Cl.[3] ..... H04R 3/00

[52] U.S. Cl. ..... 381/71; 381/86

[58] Field of Search ..... 381/71, 56, 57, 86, 381/94; 179/181 W

[56] References Cited

FOREIGN PATENT DOCUMENTS 48-82304 11/1973 Japan .

2091064 7/1982 United Kingdom ..... 381/71

*Primary Examiner*—Géne Z. Rubinson
*Assistant Examiner*—James L. Dwyer
*Attorney, Agent, or Firm*—Schwartz, Jeffery, Schwaab, Mack, Blumenthal & Koch

[57] ABSTRACT

The major resonance noise inducing engine vibration component is determined by sensing the ignition pulses produced by the engine ignition system and compared with pre-stored data to ascertain if cabin resonance is apt to occur. In the event that resonance is predicted counter vibration is produced by a speaker or speakers. In addition to the basic engine speed parameter, the load on the engine (e.g. throttle valve position, induction vacuum or the like) and the gear ratio in which the transmission is operating may also be sensed to determine the need for the counter vibration.

14 Claims, 10 Drawing Figures

METHOD AND APPARATUS FOR CONTROLLING THE SOUND FIELD IN A VEHICLE CABIN OR THE LIKE

BACKGROUND OF THE INVENTION

1. Field of the Invention

The present invention relates generally to a sound field control system and more specifically to a sound field control system which is adapted to control resonance noise produced in an enclosed space such as the cabin or passenger compartment of an automotive vehicle or the like.

2. Description of the Prior Art

As is well known in the field of automotive engineering, the rigid panels such as the floor panel, windows, door panels, roof panel or panels etc., which define the rigid cabin structure, when subjected to given vibrational excitement tend to vibrate in a manner that the cabin acts as a resonance chamber and produces a resonance or so called "booming" noise therein upon the frequency of the applied vibration reaching given levels.

In an effort to prevent this phenonmenon occuring during frequently used modes of vehicle operation (e.g. cruising), various passive measures such as the inclusion of sound damping materials, thicker and more rigid elastomeric glass support members for the windshield and other windows of the cabin and the like, have been employed. However, these measures have met with only limited success and simultaneously caused a notable increase in weight and cost of the vehicle.

FIG. 1 of the drawings shows an arrangement (disclosed in Japanese Patent Application Pre Publication No. Sho 48-82304) for actively suppressing noise produced in an enclosed space in response to the operation of a blower device associated therewith. In this arrangement a microphone 1 is disposed in the duct 2 interconnecting the blower 3 and the outlet port 4 and arranged to detect undesirable noise. A circuit 5 connected with the microphone 1 appropriately shifts the phase of the signal outputted by the microphone 1 and applies an energizing signal to a speaker 6 also disposed in the duct 2. As best seen in FIG. 2 of the drawings (which schematically illustrates the arrangement shown in FIG. 1), the sound waves produced by the speaker 2 are such as to cancel the waves which would otherwise produce an undesirable noise and thus silences the operation of the device.

However, when such an arrangement has been applied to the cabin of an automotive vehicle, for example, the result achieved has not been satisfactory.

SUMMARY OF THE INVENTION

It is an object of the present invention to provide an active noise suppressing system for a vehicle cabin which involves sensing a given parameter or parameters upon which the resonance noise in the cabin is dependent and producing, via comparison with pre-compiled data, a counter vibration which cancels the annoying noise.

In brief the invention features an arrangement wherein the major resonance noise inducing engine vibration component is determined (by sensing the ignition pulses produced by the engine ignition system) and compared with pre-stored data to ascertain if cabin resonance is apt to occur. In the event that resonance is indicated counter vibrations are produced by a vibration generating device such as an audio speaker or speakers. In addition to the basic engine speed parameter, the load on the engine (e.g. throttle valve position, induction vacuum or the like) the gear ratio in which the transmission is operating and the number of passengers in the vehicle may also be sensed to determine the need for the counter vibration.

More specifically, the present invention takes the form of a method of controlling the sound field in a space defined by structural panels, comprising the steps of: (a) sensing the magnitude of a parameter upon which the tendancy for the structural panels to vibrate and produce noise in the space is dependent, (b) producing a signal indicative of the sensed magnitude, (c) comparing the signal in a circuit containing pre-compiled data, and (d) producing a vibration within the space in accordance with the comparison of the signal with the data in a manner to cancel the sound produced by the vibration of the structural panels.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
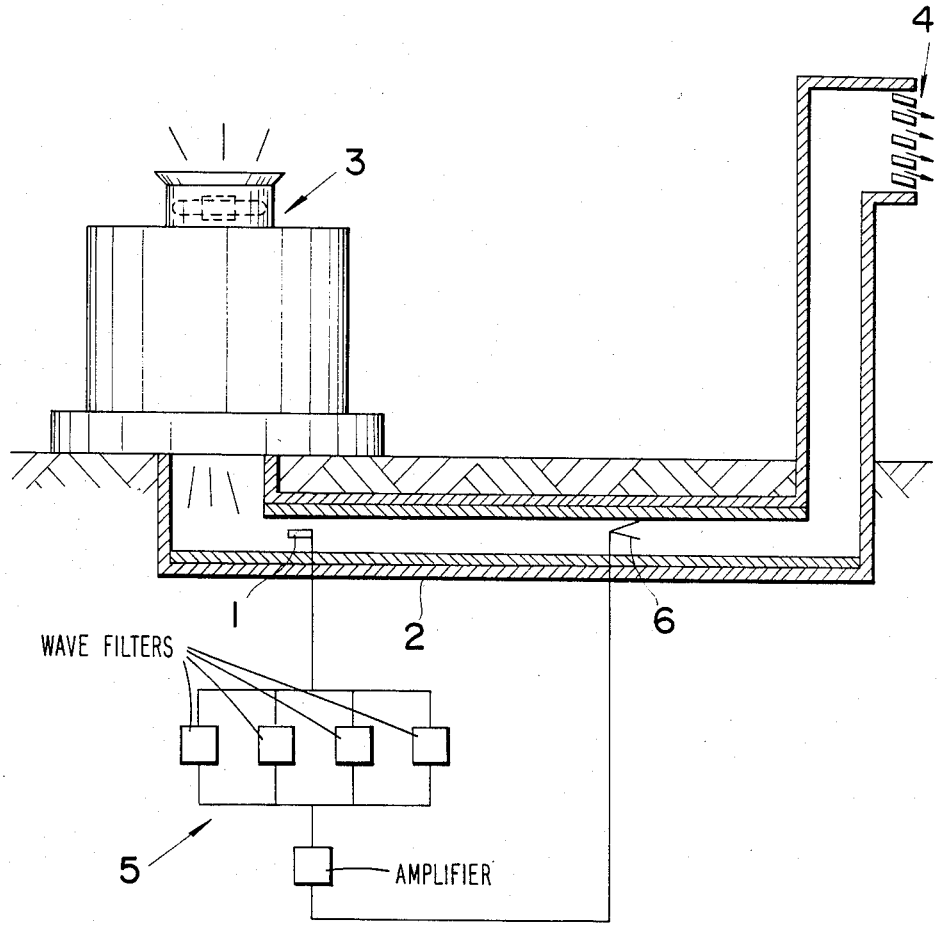
FIG.1 (PRIOR ART)
FIG. 1 is a sectional view of the prior art arrangement disclosed in the opening paragraphs of the present disclosure.
Figure 2:
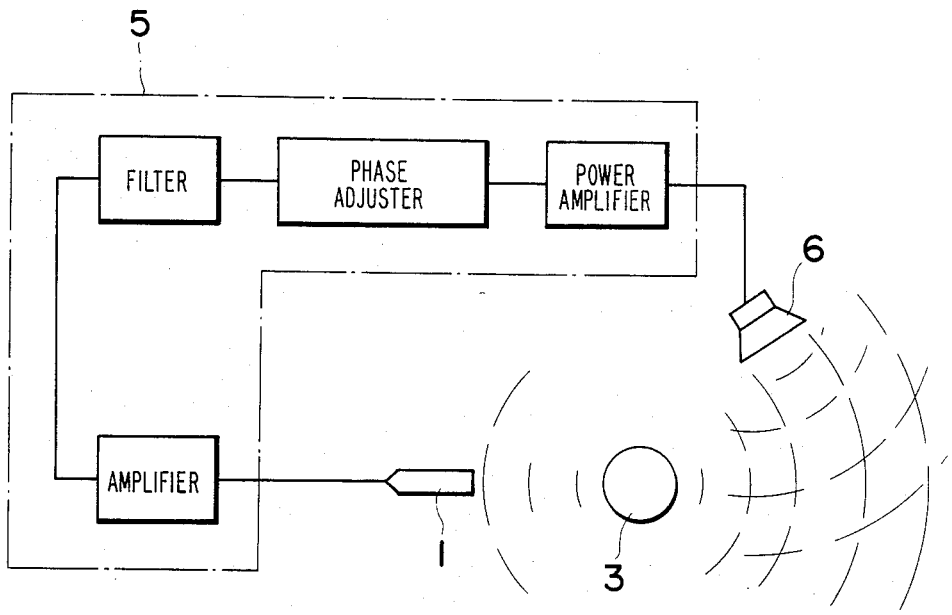
FIG.2 (PRIOR ART)
FIG. 2 is a schematic representation of the basic concept upon which the arrangement shown in FIG. 1 is based.
Figure 3:
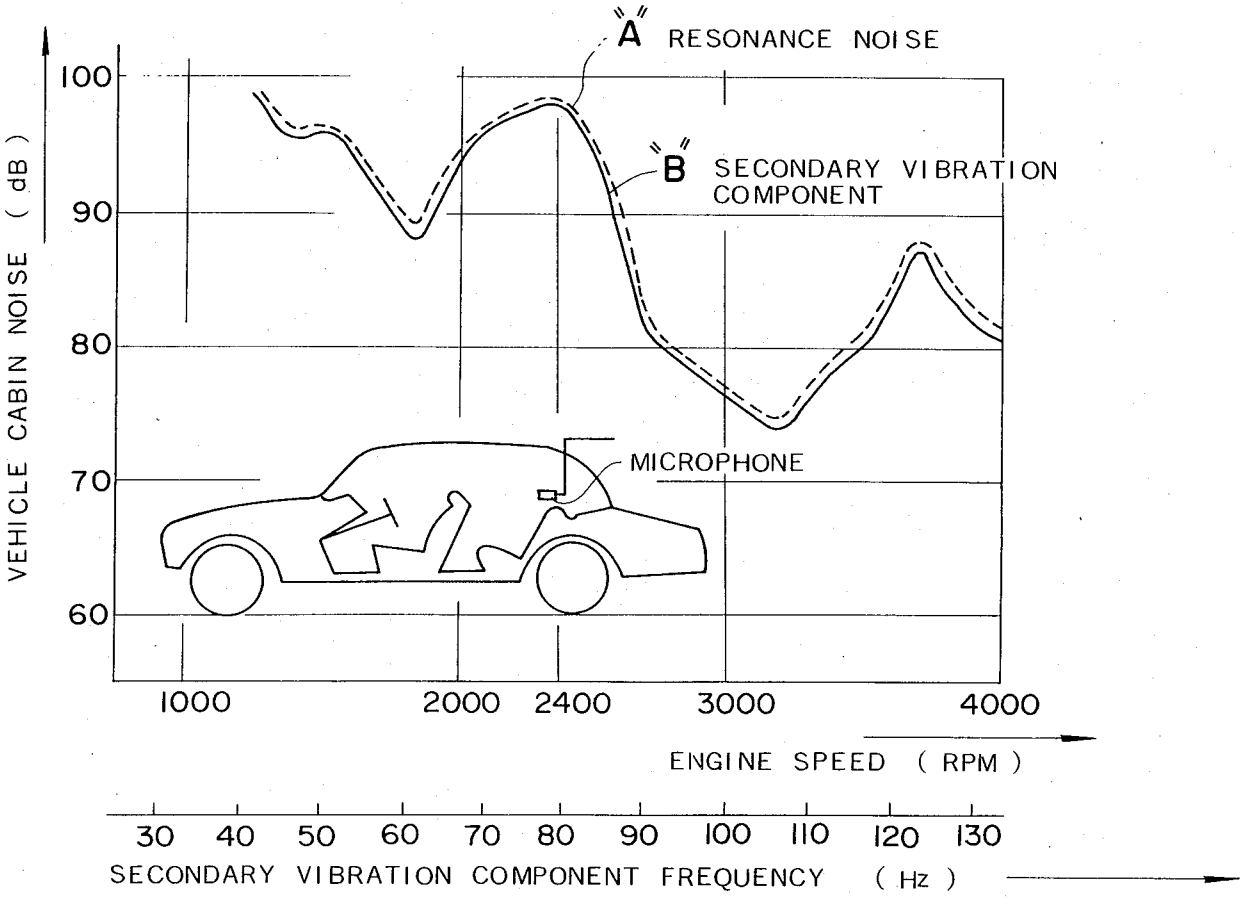
FIG. 3 is a graph showing in terms of vehicle cabin noise and engine speed, an example of the correspondence between the engine vibration and the resonance noise produced in the vehicle cabin or compartment.

Turning now to FIG. 3, an example of the resonance noise which tends to occur within a vehicle cabin is shown graphically. The data shown was recorded using a vehicle equipped with a four cylinder four cycle engine operated with the transmission associated therewith in a direct drive gear ratio and with the throttle wide open.

As will be appreciated, the resonance noise (curve "A") is dependent on engine speed (or more specifically the vibration produced by thereby—curve "B") and tends to maximize in the engine speed range of 2100 to 2700 RPM. In this instance the major resonance inducing vibration produced by the engine is the so called "secondary vibrational component" (due to the two combustions per revolution of the crankshaft). As shown, the resonance noise (broken line curve) in fact closely parallels the vibration (solid line curve). Hence, by monitoring the major vibrational component produced by the engine, it is possible to predict with some accuracy when the resonance noise is apt to be generated in a vehicle cabin or compartment.

Figure 4:
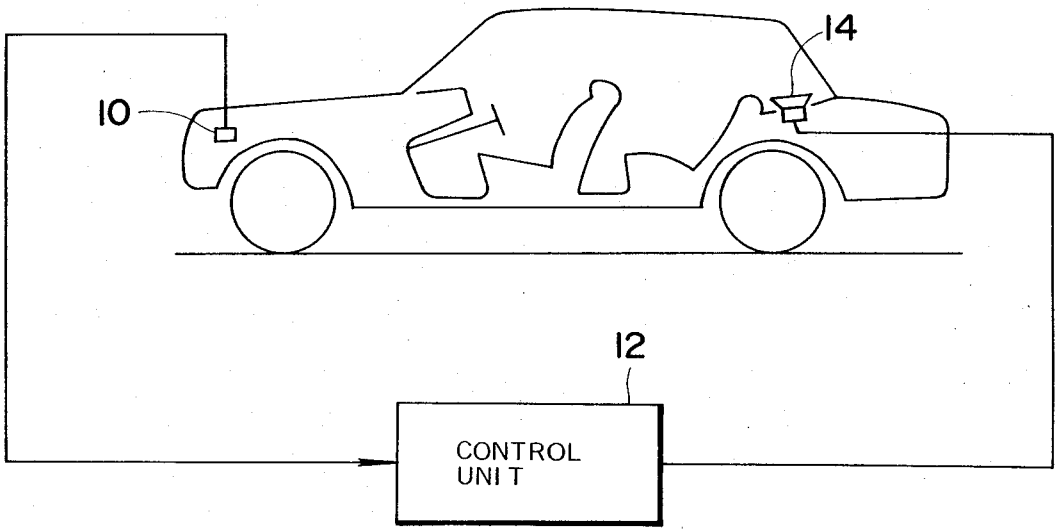
FIG. 4 is a schematic view of a first embodiment of the present invention.

FIG. 4 shows a first embodiment of the present invention. In this arrangement an engine speed sensor 10 is arranged to output a signal to a control unit 12 which includes a memory in which predetermined data is stored and which, upon the engine speed reaching a level or levels at which resonance occurs, appropriately outputs an energizing signal to a speaker 14. However, as will be appreciated, the resonance characteristics vary with the size, shape and construction of the vehicle cabin and thus must be determined individually for each type and/or model of vehicle.

Figure 5:
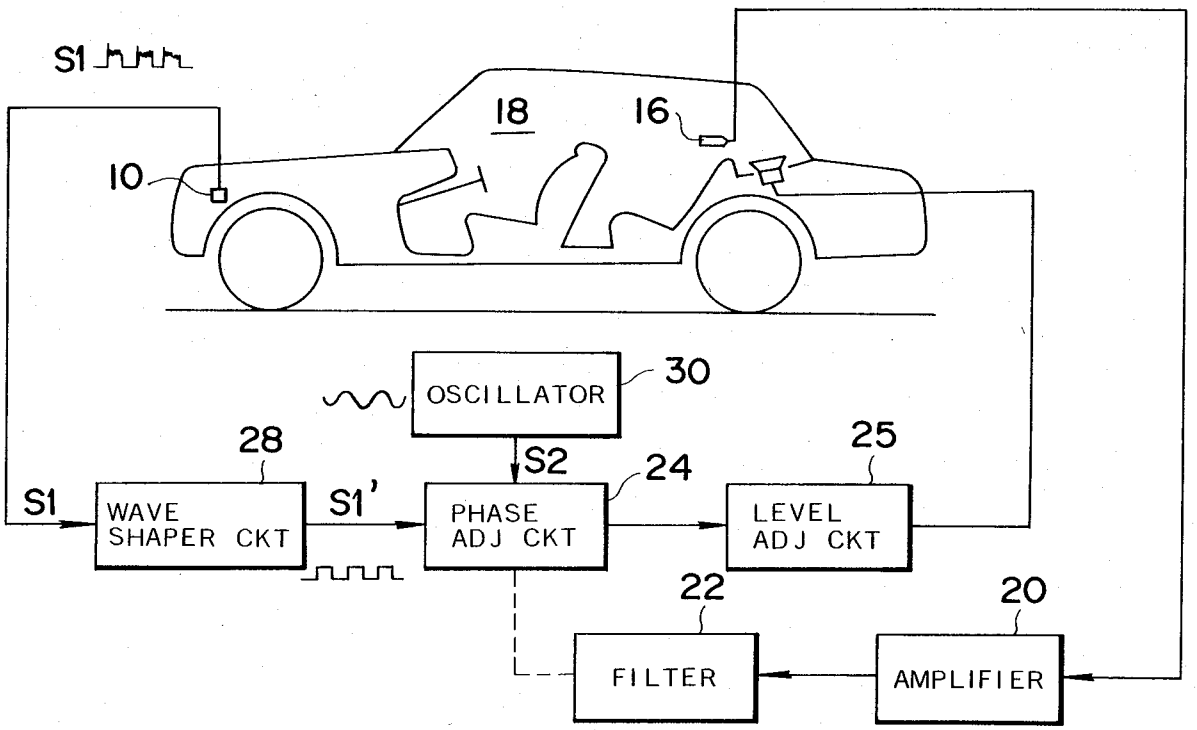
FIG. 5 is a schematic representation of an arrangement via which the data necessary for the active control may be derived.

FIG. 5, shows an arrangement suitable for determining the above mentioned characteristics. In this arrangement a microphone 16 is mounted within the vehicle cabin or compartment 18 and arranged to supply an input signal via an amplifier 20 and a filter 22 to a phase adjusting circuit 24. This circuit 24 receives inputs from an engine speed sensor 10 (for example the engine distributor) via a wave shaper 28, and from an oscillator 30. It will be noted that the engine speed signal may be advantageously tapped off from the primary side of the ignition coil as this varies with the number of engine cylinders of the engine and therefore the predominant resonance inducing vibration produced by same.

In order to compile the required data, firstly the variation of the cabin noise with engine speed is determined to ascertain the range of engine speed over which resonance occurs in the particular type or model of vehicle under examination. In this instance (by way of example) the major resonance occurs within the engine speed range of from 2100 to 2700 RPM and accordingly it is necessary to record data within this range only. Next, in order to determine the required level and change in phase of the signal to be applied to the speaker, the engine speed is raised until resonance noise is produced. This speed in the instant example may be 2400 RPM at which the maximum noise occurs. At this time the output of oscillator 30 is adjusted until the output S2 thereof matches the input S1 from the wave shaper 28. Subsequently, while using only the S2 signal produced by the oscillator 30, the phase adjusting circuit 24 and a level adjusting circuit 25 (including a power amplifier) are adjusted until the input from the microphone 16 reaches a minimum value. The frequency of the signal S2, the change in phase induced by the phase adjusting circuit 24 and amplification of the signal by the level adjusting circuit 25 are recorded. In the simplest case only one set of values may be recorded, however as will be readily apparent by incrementally increasing the engine speed and repeating the above mentioned proceedure suitable control data may be compiled from an engine speed at which resonance begins to that at which it terminates. The data obtained using the above proceedure may be set into a suitable memory device such as a read only memory (ROM) of a microprocessor, a function generator, or the like.

Figure 6:
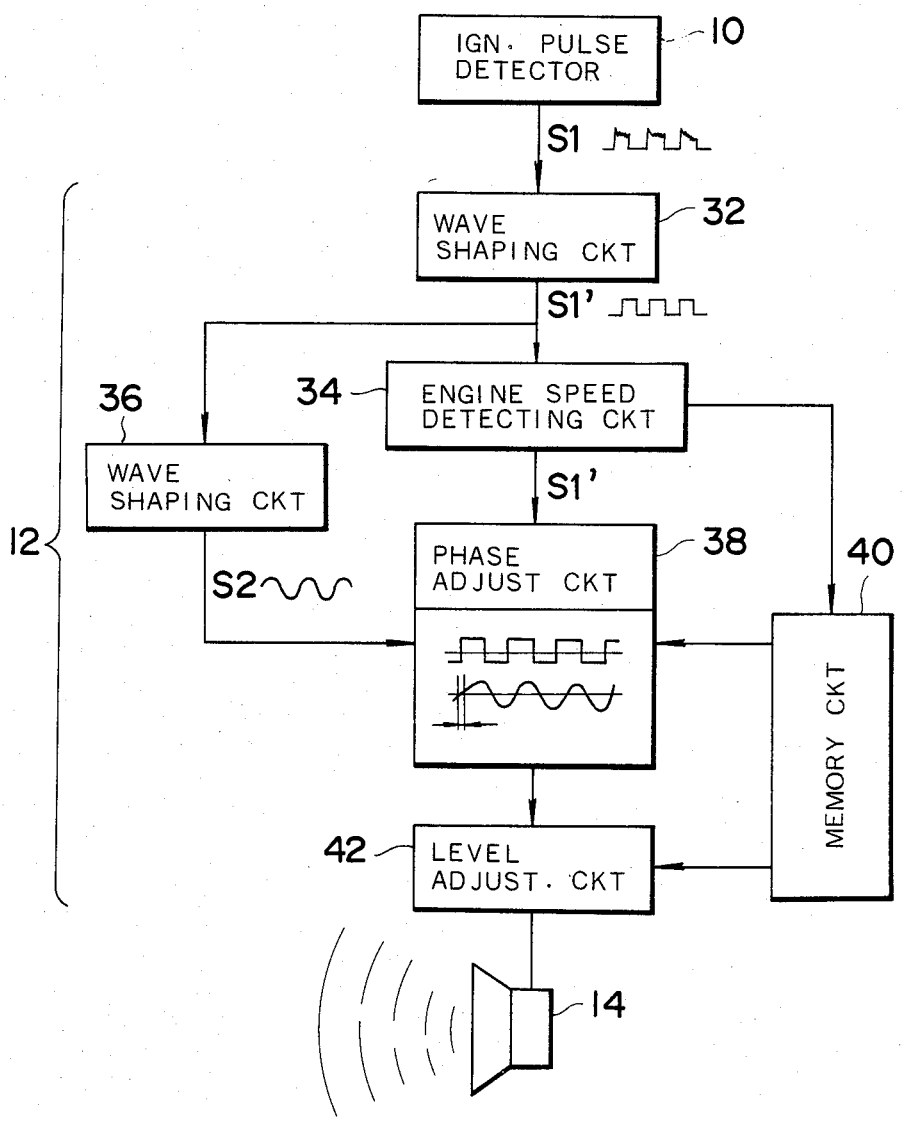
FIG. 6 is a diagram showing in function block diagram form, the circuitry of the first embodiment.

FIG. 6 shows a circuit in schematic block diagram form suitable for use in the first embodiment. In this arrangement an ignition pulse detector (engine speed sensor) 10 is connected to the control unit 12. The output (S1) of the ignition pulse detector 10 is fed to a first wave shaping circuit 32 which in turns outputs a signal (S1) to the parallel connected engine speed detecting circuit 34 and a second wave shaping circuit 36. The outputs of the just mentioned circuits 34, 36 (Viz., S1', S2) are fed to a phase adjusting circuit 38. Connected in parallel with the engine speed detecting circuit 34 and the phase adjusting circuit 38 is a memory circuit 40 in which the required phase shift and intensity level required for each given engine speed are "recorded". As shown, this circuit 40 is connected to both the phase adjusting circuit 38 and a level adjusting circuit 42 which includes a power amplifier. The output of the level adjusting circuit 42 is fed to a speaker or speakers 44.

The operation of the above described arrangement is such that the first wave shaping circuit 32 outputs a square wave signal S1', while the second wave shaping circuit 36 converts the square wave signal S1' into a sinusoidal wave signal S2 similar to that produced by the oscillator 30 shown in FIG. 5. In response to the engine speed signal S1' from the engine speed detection circuit 34 the phase adjusting circuit 38 receives an input from the memory circuit 40 indicative of the required phase shift and the phase of the signal received from the second wave shaping circuit 36 is shifted via time delay. The level of the output of the phase adjusting circuit 38 is varied in the level adjusting circuit 42 in response to the input data from the memory circuit 40 and subsequently used to energize the speaker or speakers 44.

Figure 7:
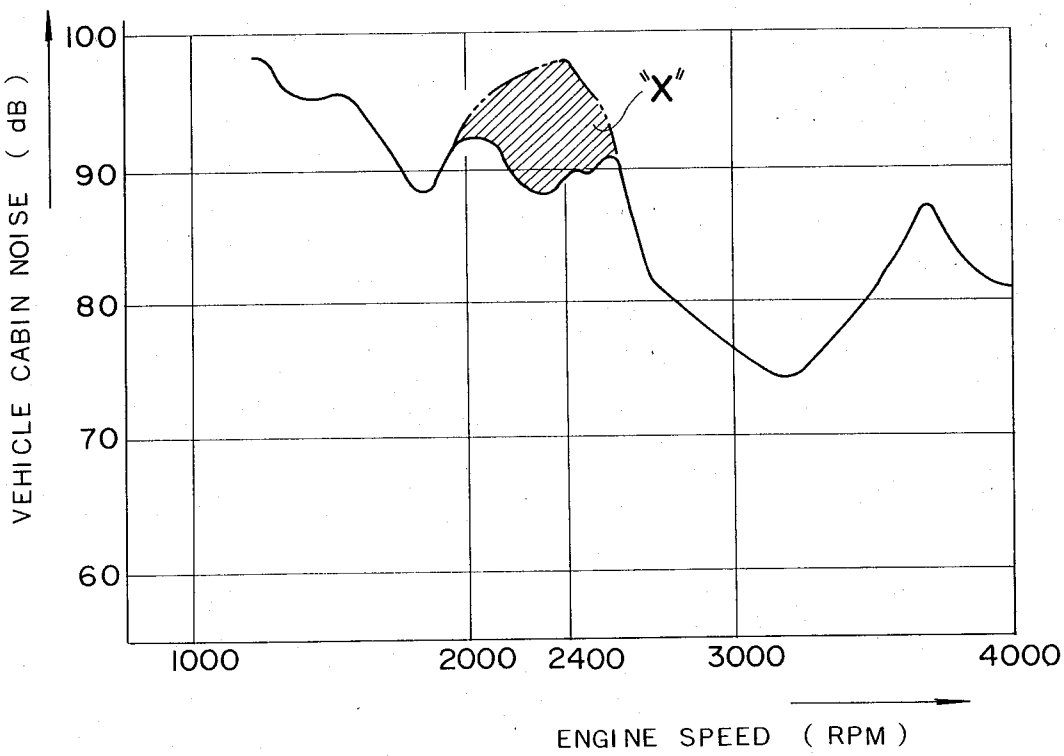
FIG. 7 is a graph showing in terms of vehicle cabin noise and engine speed the reduction in resonance noise achieved by the first embodiment.

FIG. 7 shows in graphical form the reduction in resonance (indicated by the hatched zone "X") achieved by the first embodiment.

Figure 8:
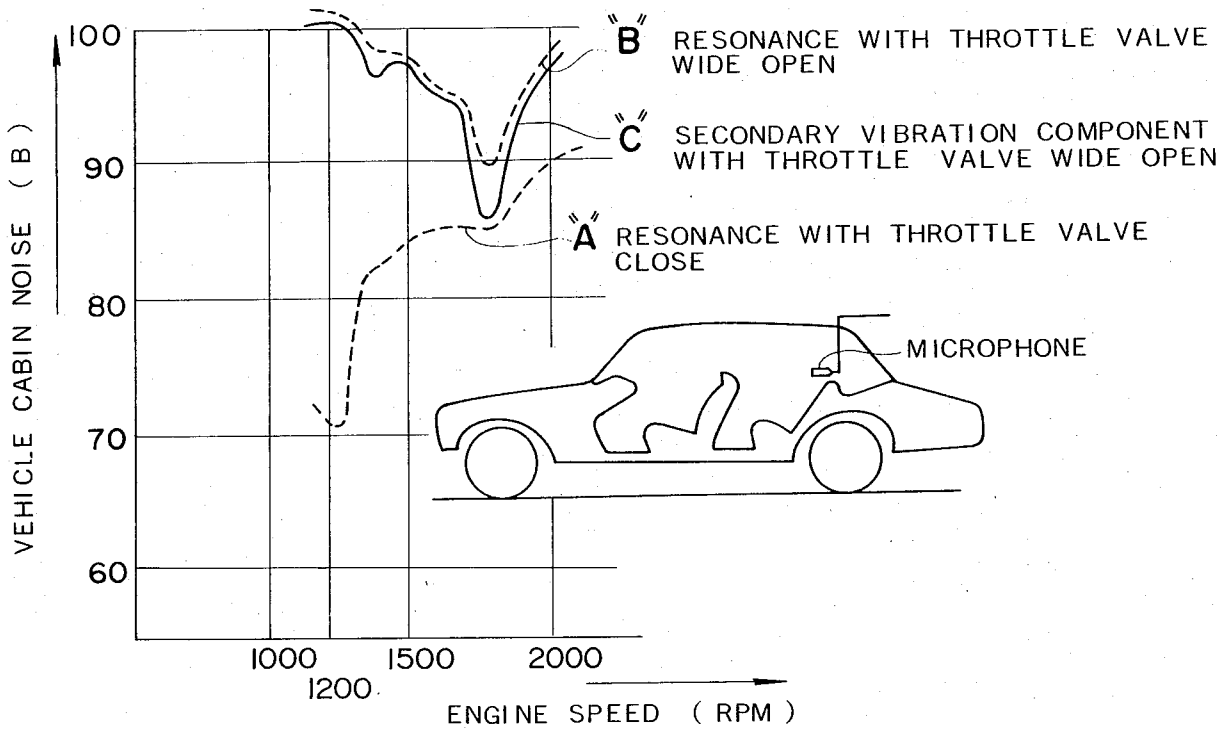
FIG. 8 is a graph showing in terms of vehicle cabin noise and engine speed, an example of the resonance characteristics and the variation therein with engine load.

FIG. 8 shows graphically the variation in resonance with load (with the transmission in direct drive). As shown by curve "A" when the throttle valve is closed (viz., the load on the engine is small) resonance tends not to occur. However, as the load on the engine increases, for example to full throttle (wide open) resonance (curve "B") is produced and varies with the major vibrational component produced by the engine (as shown by curve "C"). Moreover, it has been found that only when the transmission is in a given gear or gears (for example direct drive) that resonance occurs. Thus, with the arrangement wherein only the engine speed is detected, the speaker or speakers used to cancel the resonance noise may be energized during a mode of vehicle operation in which resonance is not in fact being produced and produce a noise of a similar nature.

Figure 9:
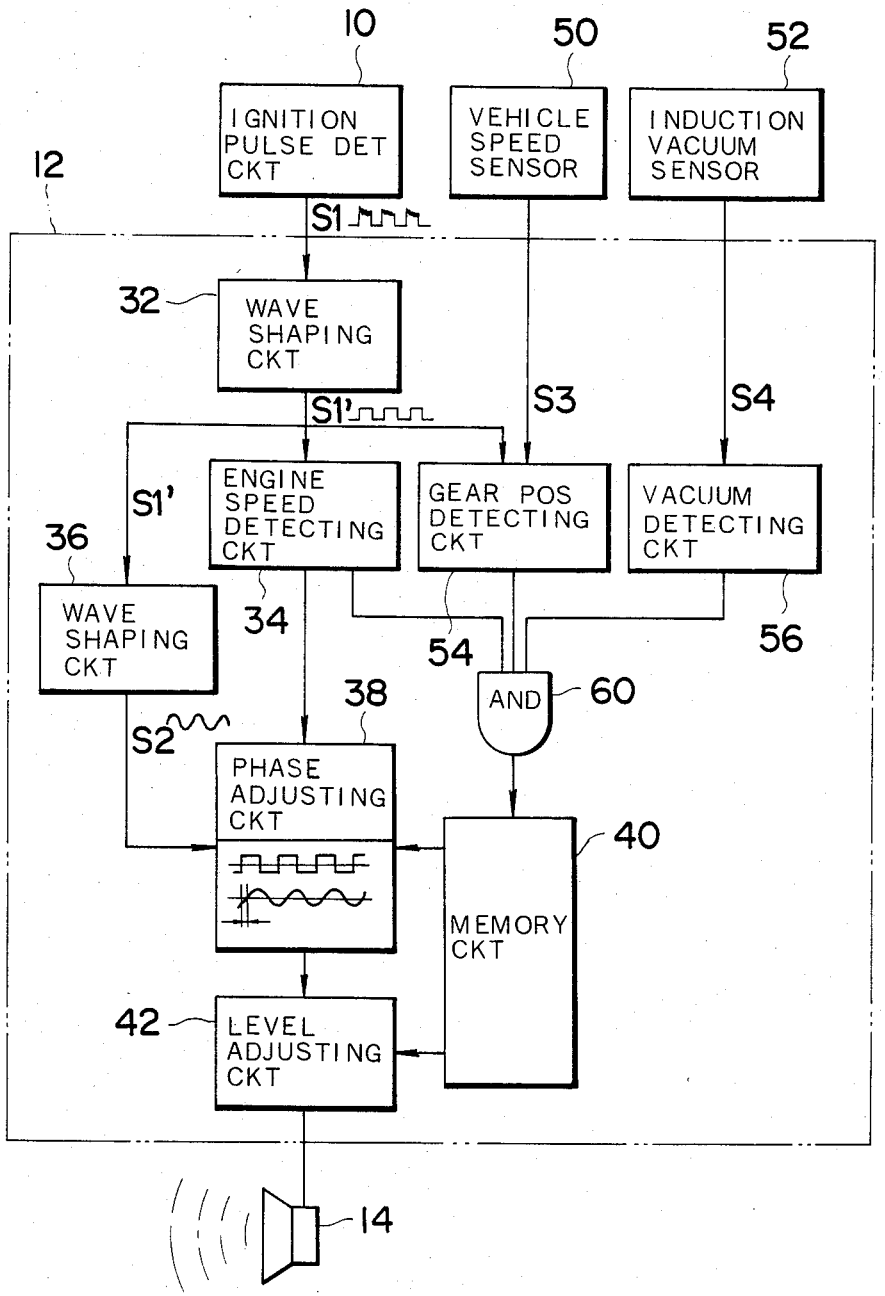
FIG. 9 is a block diagram showing the circuitry of a second embodiment of the present invention.

Accordingly, a second embodiment of the present invention features circuitry as (functionally) shown in FIG. 9 wherein the engine speed, vehicle speed, induction vacuum and transmission gear position parameters are sensed. This arrangement includes circuitry similar to that of the first embodiment and further includes a vehicle speed sensor 50 and an intake vacuum sensor 52. The vehicle speed sensor 50 is connected to a gear position detection circuit 54 which receives an input from the first wave shaping circuit 34 (Viz, engine speed signal S1') in addition to that (S3) from the vehicle speed sensor. This circuit 54 may be of the type wherein the gear position is calculated only on the basis of the vehicle speed and the engine speed and thus require no separate input. Disclosure relating to such a circuit may be found in copending U.S. patent application Ser. No. 302,296. The output (S4) of the intake vacuum sensor 52 is received by a vacuum detecting circuit 56. The outputs of the engine speed detecting circuit 34, the gear position detection circuit 54 and the vacuum sensor 52 via a vacuum level detecting circuit 58 are fed to an AND gate 60 which is connected to the memory circuit 40 in a manner that only when all of the conditions under which resonance noise is apt to occur are met (viz,. the engine speed and induction vacuum are within predetermined ranges and the transmission is in a predetermined position), the memory circuit 40 outputs the appropriate signals to the phase adjusting circuit 38 and the level adjusting circuit 42.

Figure 10:
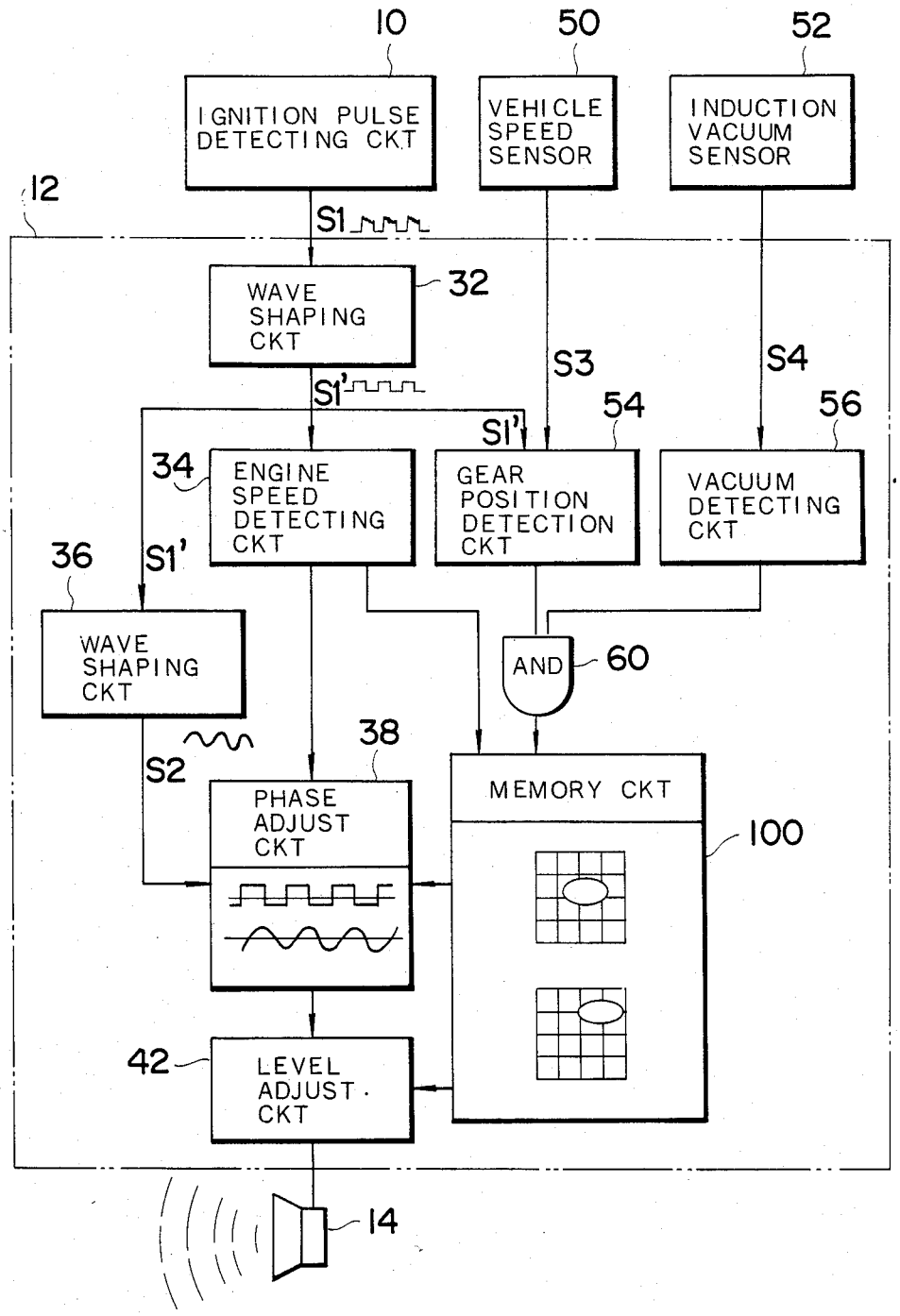
FIG. 10 is a circuit diagram in block form of a third embodiment of the present invention.

FIG. 10 shows a third embodiment of the present invention wherein the memory circuit 100 contains data recorded at 50 RPM intervals over a range of 1000 to 1500 RPM (merely by way of example). With this arrangement, the output of the AND gate 60 is arranged only to act as trigger to render the memory circuit 100 operative and the output of the engine speed detecting circuit 34 fed thereto separately. In this arrangement the memory circuit 100 advantageously takes the form of a ROM of a micropressor in which a plurality of suitable look-up tables or the like are stored.

Investigation has further revealed that, as the floor panel (in particular) has a limited rigidity the vibrational characteristics thereof are notably influenced by the number of passengers in the vehicle. Accordingly, it is possible according to the invention to place sensors or switches below the seats and use the number of passengers (and/or baggage etc) in the vehicle which influences the vibration of the floor panel as a parameter for determining the need for resonance noise control. Moreover, as the vehicle cabin is such that the resonance frequencies in the longitudinal direction, the lateral direction and the vertical directions thereof are different, (for example 70 to 90 Hz, 120 to 140 Hz and 130 to 150 Hz respectively) it is possible to use directional microphones, record data for each of the three major directions and individually energize speakers disposed in the dash panel, the doors and the roof (for example) in a manner to selectively cancel the resonances in each of the aforementioned directions. In this instance a microcomputer having a ROM is the most suitable form of memory circuit for use with this embodiment due to the complexity of the data which must be compiled and stored.

What is claimed is:

1. A method of controlling the sound field in a space defined by structural panels, comprising the steps of:

pre-storing data indicative of the magnitude of a non-acoustic parameter upon which the tendency for said structural panels to vibrate in said space depends;

sensing the magnitude of said non-acoustic parameter upon which the tendency for said structural panels to vibrate and produce noise in said space is dependent;

producing a signal indicative of the sensed magnitude;

comparing said signal with said pre-stored data; and producing a vibration within said space in accordance with said comparison of said signal with said data in a manner to cancel the sound produced by the vibration of said structural panels.

2. A method of controlling the sound field in a passenger compartment of a vehicle having an engine and wherein said passenger compartment takes the form of an enclosed space defined by structural panels, comprising the steps of:

sensing a vibration of said engine which vibration tends to vibrate said structural panels and produce an audible resonance sound therein;

producing a signal indicative of the sensed vibration;

comparing said signal with data pre-stored in a memory; and producing an audio frequency vibration within said compartment in accordance with said comparison of said signal and said data which vibration cancels said audible resonance sound.

3. A method as claimed in claim 2, further comprising the steps of:

sensing the load on the engine; and permitting the production of said vibration when the load on said engine is sensed to be within a predetermined range.

4. A method as claimed in claim 2, further comprising the steps of:

sensing the gear position of a transmission associated with said engine; and permitting the production of said vibration only when said gear position is sensed to be in a predetermined position.

5. A method as claimed in claim 2, further comprising the steps of:

sensing the weight acting on a floor panel of said passenger compartment which floor panel defines one of said structural panels; and modifying the production of said vibration in response to the sensed weight.

6. A method as claimed in claim 2, further comprising the steps of:

individually producing vibrations which selectively cancel audible resonance noise vibrations hich occur in the longitudinal, lateral and vertical directions within said passenger compartment.

7. A method as claimed in claim 2, comprising the step of: using the ignition pulses of said engine to sense said vibration.

8. An apparatus which controls a sound field in a space defined by structural panels comprising:

a sensor for sensing a non-acoustic parameter upon which the tendency for said structural panels to vibrate and produce noise in said space is dependent, and (b) producing a signal indicative thereof;

a circuit including a memory in which data is pre-stored, said circuit being arranged to compare said signal with said pre-stored data; and a vibration generating device disposed in said space, said vibration generating device being operatively connected with said circuit in a manner to be energized thereby to produce a vibration which cancels the noise produced by said structural panels vibrating, in response to the comparison carried out in said control device indicating that said noise will be produced.

9. An apparatus which controls the sound field in a passenger compartment of a vehicle having an engine and wherein said passenger compartment takes the form of an enclosed space defined by structural panels, comprising:

an engine vibration sensor for (a) sensing a vibration of said engine which tends to vibrate said structural panels and produce an audible resonance sound therein, and (b) producing a signal indicative thereof;

a circuit including a memory in which data is prestored, said circuit being arranged to receive said signal and compare same with said data; and an audio frequency vibration generating device disposed in said compartment, said device being arranged to be energized by said circuit in response to the comparison of said signal with said data indicating that audible resonance noise will be produced in said compartment and produce a vibration which cancels said audible resonance noise.

10. An apparatus as claimed in claim 9, further comprising an engine load sensor for sensing the load on said engine and producing a signal indicative thereof, said circuit being arranged to be responsive to the output of said load sensor in a manner to permit said audible resonance noise cancelling vibration to be produced only when said load is sensed to be within a predetermined range.

11. An apparatus as claimed in claim 9, further comprising a gear position sensor for sensing the gear position of a transmission associated with said engine and producing a signal indicative thereof, said circuit being arranged to permit said audible resonance sound cancelling vibration only when said gear position sensor indicates that the transmission associated with said engine is in a predetermined gear position.

12. An apparatus as claimed in claim 9, further comprising a weight sensor for sensing the weight applied to a floor panel of said passenger compartment which floor panel defines one of said structual panels, said circuit being arranged to modify the energization of said device in response to the output of said weight sensor.

13. An apparatus as claimed in claim 9, wherein said device is arranged to produce vibrations which selectively cancel resonance noise occuring in the longitudinal, lateral and vertical directions of said compartment respectively.

14. An apparatus which controls the sound field in a compartment of a vehicle having an engine, wherein said compartment comprises an enclosed space defined by structural panels, said apparatus comprising:

a sensor for (a) sensing an engine operational parameter which varies in accordance with the tendency for an audible resonance sound to be produced in said compartment and for (b) producing a signal indicative of said sensed parameter;

a circuit including a memory in which data is prestored, said circuit being arranged to receive said signal and compare said signal with said data; and an audio frequency vibration generating device disposed in said compartment, said device being arranged to be energized by said circuit in response to the comparison of said signal with said data indicating that audible resonance noise will be produced in said compartment and produce a vibration which cancels said audible resonance noise.

* * * * *